United States Patent [19]

Rath

[11] 4,056,038

[45] Nov. 1, 1977

[54] DUAL PURPOSE SEMI-AUTOMATIC CONVERTIBLE RIFLE

[76] Inventor: Hans M. Rath, 116 Sproul Lane, Staunton, Va. 24401

[21] Appl. No.: 685,651

[22] Filed: May 12, 1976

[51] Int. Cl.[2] ..... F41C 21/10

[52] U.S. Cl. ..... 89/128; 42/16; 42/50; 89/1 K; 89/139; 89/148; 89/184; 89/199

[58] Field of Search ..... 42/77; 89/29, 128, 190

[56] References Cited

U.S. PATENT DOCUMENTS

| | | | |
|---|---|---|---|
| 2,159,126 | 5/1939 | Birkigt | 89/190 |
| 2,577,026 | 12/1951 | Maillard | 89/190 |

FOREIGN PATENT DOCUMENTS

| | | | |
|---|---|---|---|
| 1,191,260 | 4/1965 | Germany | 89/29 |

*Primary Examiner*—Stephen C. Bentley

*Attorney, Agent, or Firm*—B. P. Fishburne, Jr.

[57] ABSTRACT

A semi-automatic sporting rifle, firing high powered center fire cartridges, is easily and quickly convertible to a 22 rimfire rifle without loss of feel or balance. The dual purpose rifle features a short stroke, gas operating system which is rendered inactive when the rifle is converted to 22 rimfire action. In the conversion, a locking bolt assembly and magazine for high powered ammunition are replaced by a non-locking bolt and a combined cartridge adapter and magazine holder for 22 calibre rimfire ammunition. The principal components of the firearm, including barrel, receiver, firing mechanism, action spring, magazine latch, bolt connecting link, charging handle, sights, stock and forearm, are common to both forms of the rifle. The conversion may be accomplished by using only a pointed object, such as a bullet point or ball point pen.

8 Claims, 22 Drawing Figures

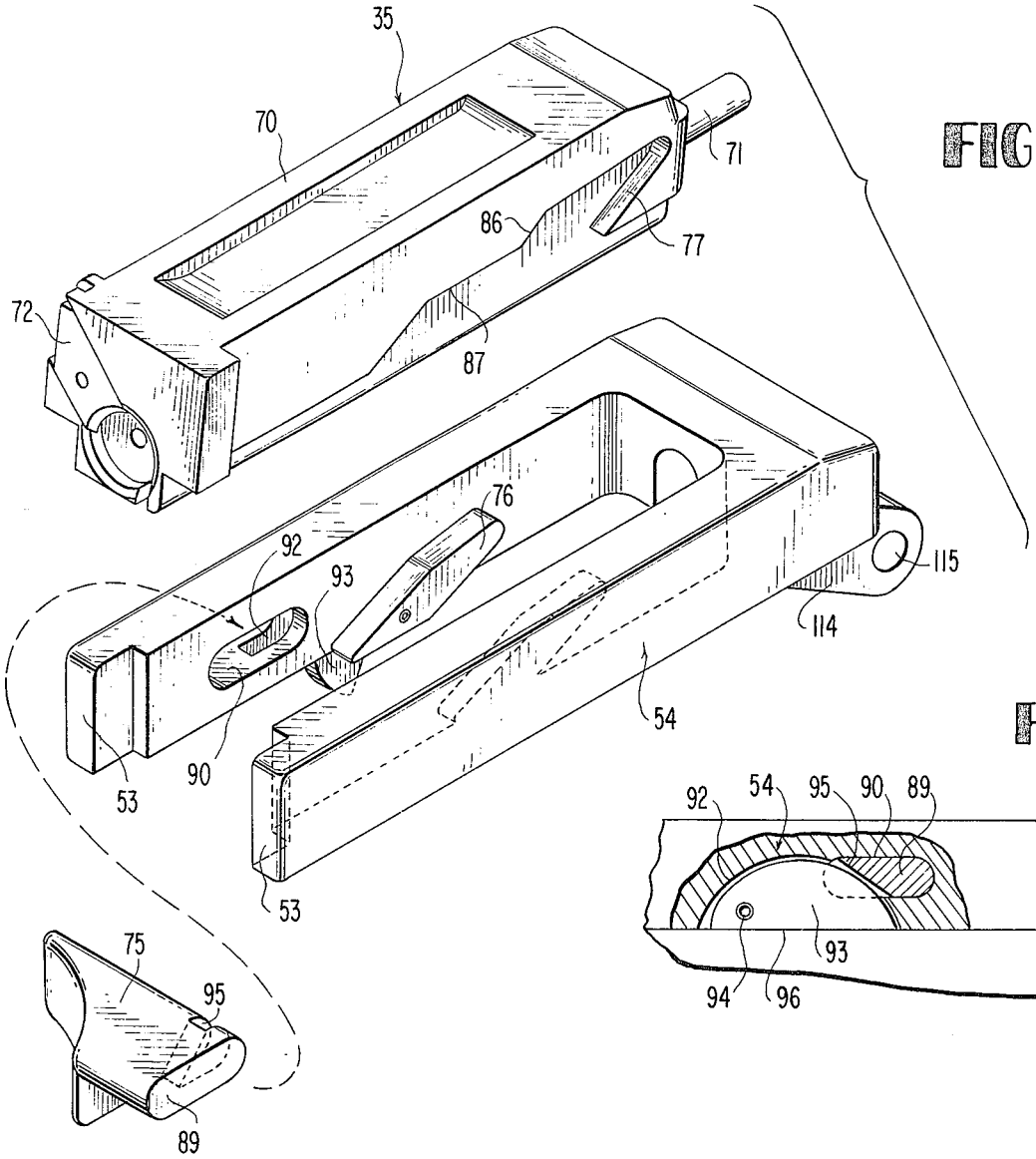
FIG 10
FIG 11
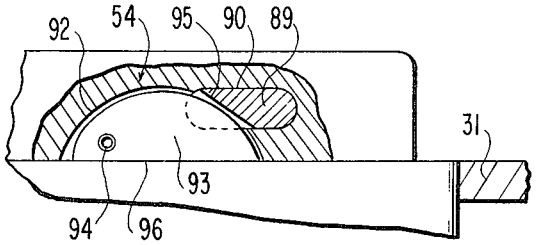
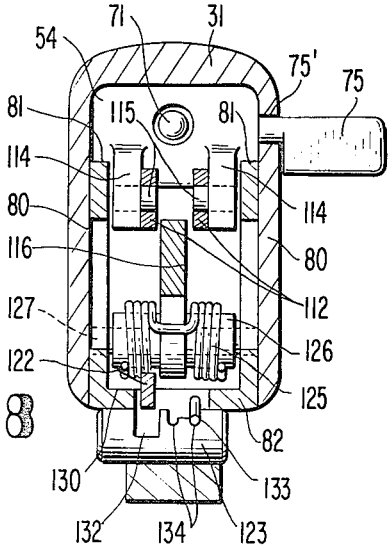
FIG 8
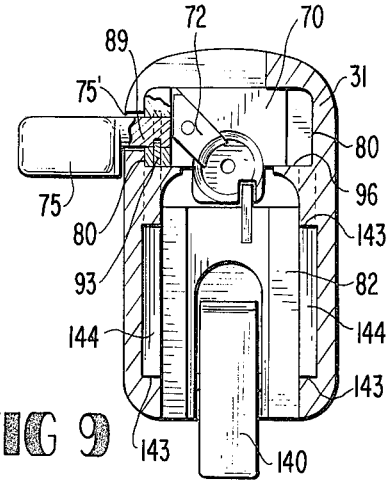
FIG 9

37
105
103
102
106
101
98
100
13
99
109
97
104
103
106
13
106
102
32
37
155
88
92
91
93
94
157
142
79
74
107
110
73
108
141
111
31
81
82
80
34
148
138
145
147
151
156
146
150

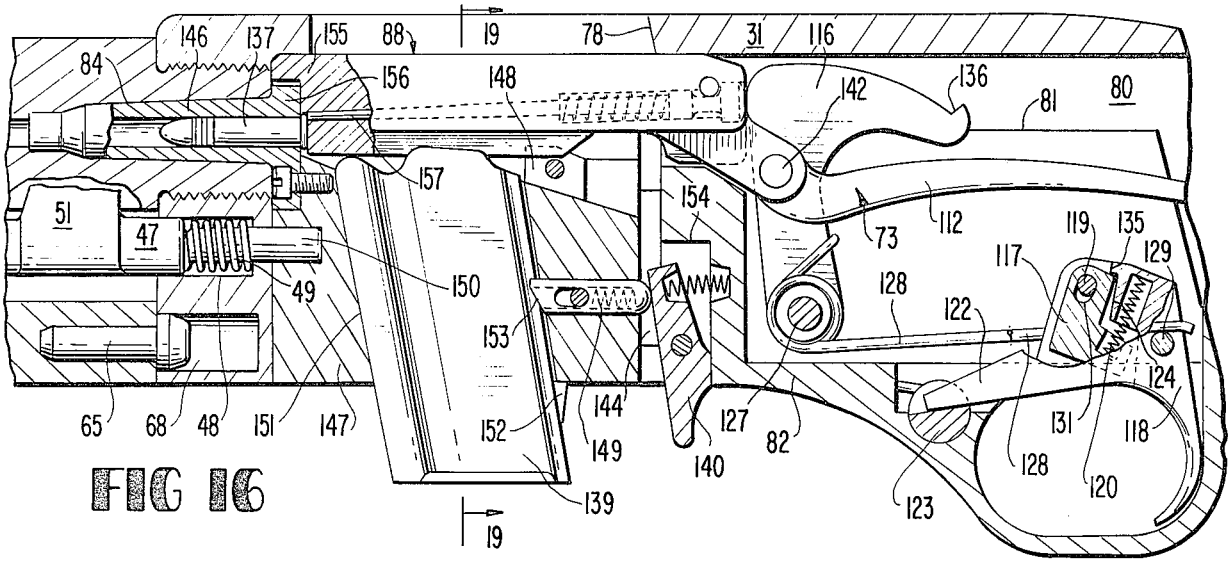
FIG 16
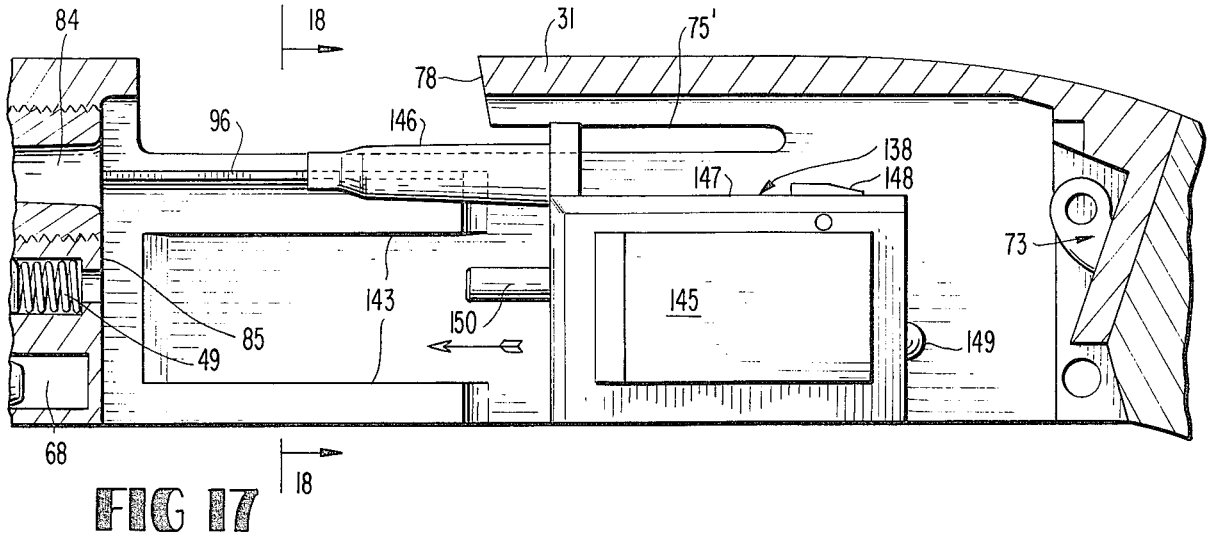
FIG 17
FIG 19
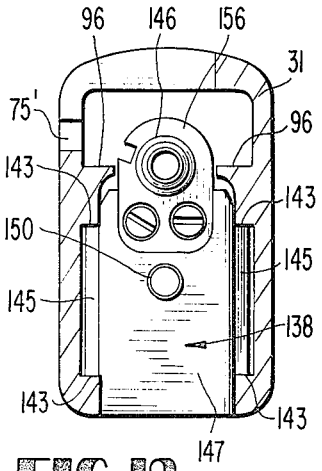
FIG 18
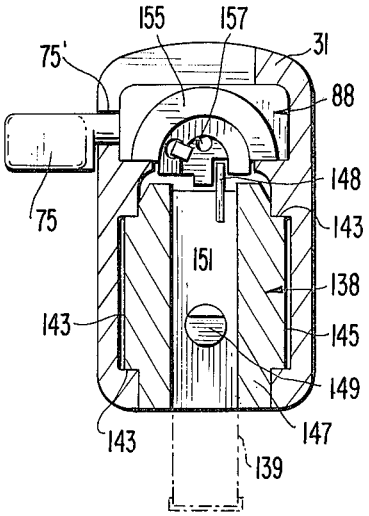

DUAL PURPOSE SEMI-AUTOMATIC CONVERTIBLE RIFLE

BACKGROUND OF THE INVENTION

The broad concept of a firearm designed for one type of ammunition, such as high powered center fire cartridges, and convertible to a second form of ammunition, such as 22 calibre rimfire cartridges, is known in the prior art. One example of the patented prior art showing such a convertible firearm is U.S. Pat. No. 3,776,095, issued Dec. 4, 1973 to Atchisson.

The general object of the present invention is to improve on the known prior art by providing an easily and quickly convertible sporting rifle of the semi-automatic type which may be fired as rapidly as the trigger can be pulled in both forms or versions of the invention. The invention was conceived with the idea of converting a high powered sporting rifle at little cost to a 22 calibre rimfire rifle for small game hunting, target practice, indoor shooting, and the like, in the belief that such a convertible firearm would appeal to a variety of gun enthusiasts.

Governing factors in the designing of the firearm were simplicity of construction, ease of assembly and disassembly, ruggedness and durability, simplicity and safety in operation, aesthetic appeal, and the capability of mounting all types of open sights and scopes.

A further and more specific objective of the invention is to provide a convertible semi-automatic sporting rifle of the mentioned type which has fewer and less complex parts than the known prior art, and in which there is absolutely no possibility of assembling the rifle incorrectly in either version thereof.

SUMMARY OF THE INVENTION

The invention relates to firearms, and more particularly to a dual purpose semi-automatic sporting rifle including a locking bolt assembly as required for high powered center fire ammunition, a non-locking blowback bolt generally used for 22 rimfire rifles and being interchangeable in the invention with the locking bolt assembly. The invention additionally employs a unique short stroke gas operating system, an improved firing mechanism, and simplified conveniently employed conversion components including an adapter unit for low cost 22 rimfire cartridges and a magazine for such cartridges.

A feature of the invention is that the short stroke locking bolt gas powered actuator is automatically rendered inactive when the conversion to 22 rimfire blowback action is made.

All principal parts of the firearm, such as barrel, receiver, firing mechanism, stock, forearm, charging handle, and sights remain the same in both forms of the invention. The conversion requires no tools except a simple pointed object.

Other unique features of the invention are a simple and quick-acting tension release means for the main spring or action spring, tilting locking bolt for the high powered version of the rifle and associated bolt carrier having open forward ends to receive a direct impact from the short stroke gas-operated bolt actuator, and an improved forearm latching arrangement which coacts with the gas operating system to properly position critical components thereof.

Other important features of the invention, differing from the prior art, will become apparent during the course of the following detailed description.

It should be stated that the convertibility feature pertains only to rifles firing high powered center fire cartridges, such as the .222 Rem., .222 Rem. Magnum, .223 Rem. (5.56MM), 22-250 Remington and the like having a bullet diameter of .224 inches and to rimfire cartridges generally known as 22 Long Rifle, 22 Long Rifle (Rifle Match), 22 Long Super X, 22 Long Rifle Super X, Super Speed and the like.

BRIEF DESCRIPTION OF DRAWING FIGURES

FIG. 8 is a transverse vertical section taken on line 8—8 of FIG. 6.

FIG. 9 is a similar section taken on line 9—9 of FIG. 7.

FIG. 10 is an exploded perspective view showing a locking bolt, bolt carrier and charging handle.

FIG. 11 is a fragmentary side elevational view, partly in section, showing means for locking or retaining the charging handle on a bolt.

FIG. 16 is a longitudinal vertical cross section, similar to FIGS. 6 and 7, showing the 22 calibre long rifle rimfire action in firing position.

FIG. 17 is a further longitudinal vertical cross section through the receiver illustrating the introduction of the 22 calibre rimfire cartridge and magazine adapter unit through the rear bottom of the receiver.

FIG. 18 is a transverse vertical section taken on line 18—18 of FIG. 17.

FIG. 19 is a similar section taken on line 19—19 of FIG. 16 with the non-locking bolt retracted.

DETAILED DESCRIPTION

Figures 1, 2, 3:
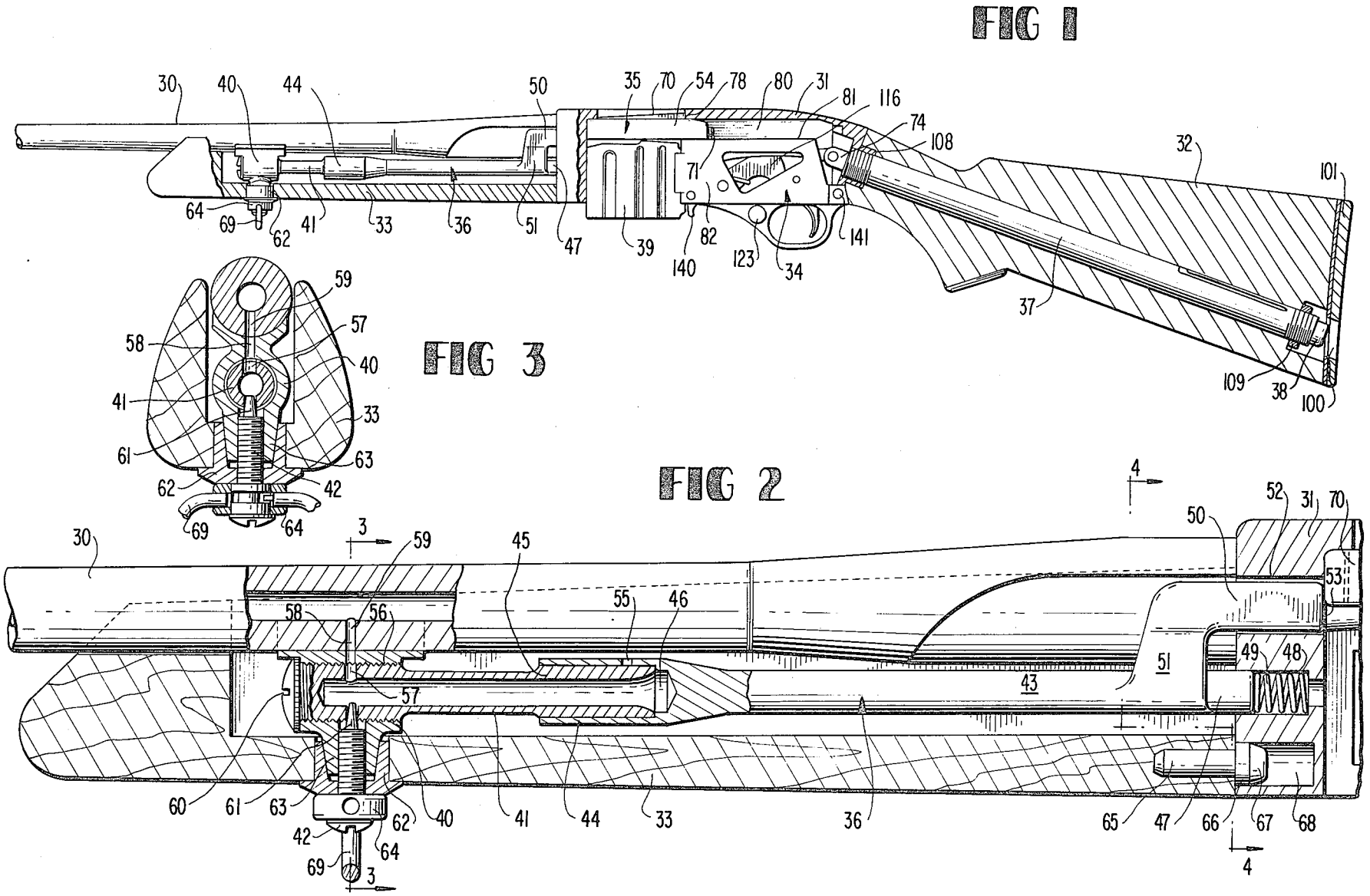
FIG. 1 is a side elevation, partly in section, of a dual purpose convertible sporting rifle embodying the invention.
FIG. 2 is an enlarged fragmentary central vertical longitudinal section, partly in elevation, taken through the forearm and associated gas operated bolt actuating means.
FIG. 3 is a transverse vertical section taken on line 3—3 of FIG. 2.

Referring to the drawings in detail, wherein like numerals designate like parts, FIG. 1 depicts a dual purpose semi-automatic convertible sporting rifle in its entirety, with the proper components installed to enable the firing of high powered center fire cartridges of the type previously identified. As illustrated in FIG. 1, the rifle includes a barrel 30, receiver 31, buttstock 32 and forearm 33. It further includes a firing assembly or mechanism 34, locking bolt assembly 35, shown in the locked or closed position, and a short stroke gas operated actuator 36 for the bolt assembly 35. Additionally, FIG. 1 shows a tubular action or main spring housing 37, an action spring tension quick-release means 38, and a magazine 39 for high powered center fire ammunition. The interaction of these principal components, as well as those employed to convert the rifle to a 22 calibre long rifle rimfire cartridge rifle, will be fully described as the description proceeds.

SHORT STROKE GAS SYSTEM

Referring primarily to FIGS. 1 through 3, an important feature of the invention is the provision of a short stroke gas system beneath the gun barrel 30 and covered by the forearm 33, as shown, rather than placing this system on top of or on one side of the rifle which is undesirable in a sporting rifle. The gas system comprises a gas transfer block 40 which is integral with the barrel 30, a gas transfer tube 41, a pointed screw 42 located in the gas transfer block 40, and the actuator 36 already identified in FIG. 1.

Figure 5:
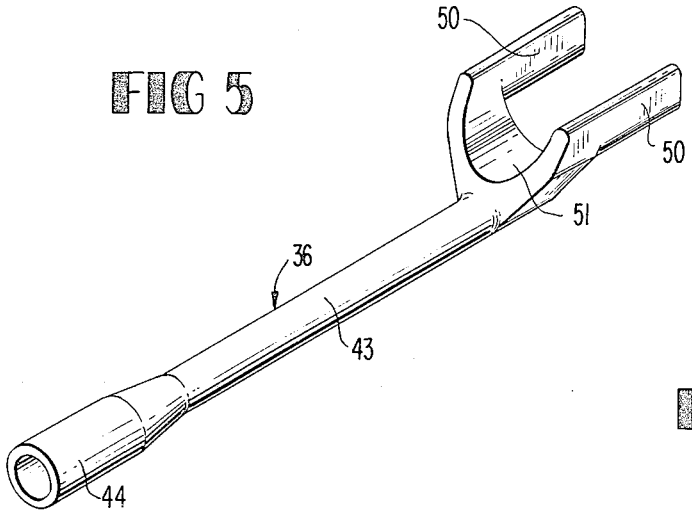
FIG. 5 is a perspective view of the gas operated locking bolt actuator.

The actuator 36 is also shown in FIG. 5 and includes an elongated bar body 43 having a leading end cylindrical sleeve 44 which telescopes slidably over a cylindrical rear end portion 45 of the relatively stationary gas transfer tube 41. A short chamber or pocket 46 for the usual deposits inherent in gas operated firearms, such as carbon and minute bullet particles, is provided at the base of the sleeve 44 and adjacent the outlet of gas transfer tube 41.

The actuator 36 further comprises a cylindrical rear extremity 47 received slidably in a coaxial bore 48 in the forward end of receiver 31. The element 47 is opposed by an actuator return spring 49 in the bore 48. A pair of spaced parallel arms or extensions 50 of oblong cross section are integrally joined with the bar body 43 through a saddle 51 which underlies the barrel 30, the arms 50 symmetrically straddling the barrel on opposite sides thereof and being received movably in a pair of registering oblong openings 52, FIG. 6, in the leading end of the receiver 31. When thrust rearwardly through these openings 52 by gas pressure, the rear ends of the elements 50 strike the opposing open forward ends 53 of a bolt carrier 54, FIG. 10, to be fully described. The bolt carrier 54 is a part of the locking bolt assembly 35 identified in FIG. 1 and depicted in FIG. 10.

The gas operated actuator 36 has a gas exhaust port 55 in its sleeve 44 through which gas is exhausted following a short forward movement of the actuator 36 (approximately ¼ inch) prior to the return of the actuator to its normal rest position shown in FIG. 2 by the spring 49. The forward movement of the actuator 36 is limited by contact of the saddle 51 with the forward end face of receiver 31.

The forward end of gas transfer tube 41 has threaded engagement at 56 within the transfer block 40 and the bore of the gas transfer tube communicates with the bore of barrel 30 through an inlet port 57 which registers with similar ports 58 and 59 formed in the block 40 and barrel 30. A screwdriver slot 60 at the front of gas transfer tube 41 allows adjusting of this tube to obtain proper registration of the ports 57 and 58, after which the point 61 of screw 42 locks the tube 41 in the properly adjusted position to maintain the registry of the gas ports.

The gas system departs from prior art concepts by providing a rigid unitary actuator 36 with the twin push arms 50, as described. The use of a tubular cartridge magazine as a guide for a piston or the like is absent in the invention, thus preventing dangerous overheating of unspent cartridges, as well as preventing hot gases from blowing into the receiver or being diverted into the face of the shooter.

Another feature of the invention closely related to the improved gas system and also shown in FIGS. 1 to 3 is an improved arrangement for attaching the forearm 33 in covering relationship to the described short stroke gas operating system. The forearms of semi-automatic sporting rifles and shotguns tend to loosen because of recoil shocks and heat, and this is extremely unpleasant for the shooter even though the condition may not be dangerous in terms of the forearm detaching itself from the rifle. The improved forearm attaching means which overcomes this problem completely comprises a bushing 62 which has a slightly tapered bore receiving a conically tapered extension 63 on the bottom of gas transfer block 40. These interfitting tapered elements are not self-locking but do provide a wedging connection. The screw 42 which carries a swivel ring 64 passes through the bushing 62 and is threaded into the extension 63 of the gas transfer block, thus locking the front portion of the forearm 33 securely into position. Preferably, the metal bushing 62 is pressed into an opening in the wooden forearm thus becoming an integral part of the forearm.

Figure 4:
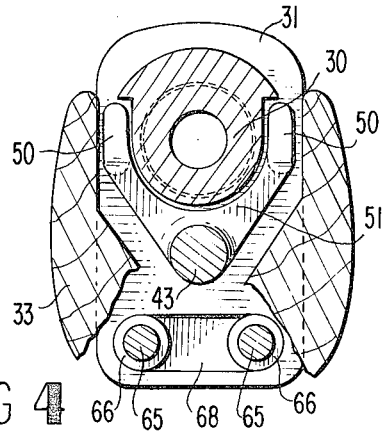
FIG. 4 is a similar section taken on line 4—4 of FIG. 2.

At its rear end, the forearm 33 has a pair of laterally spaced pins 65 pressed into openings thereof so as to become integral therewith. These pins have cylindrical heads 66 which are tapered at 67 and the heads abut the rear end face of the forearm as shown in FIG. 2. The short heads are received in a matching recess 68, FIG. 4, in the forward end face of receiver 31, thus securely and rigidly locking the rear of the forearm in place. To disassemble the forearm, the screw 42 is removed and the forearm will pivot about the tapered portions 67 of the rear pins and easily detach itself from the taper 63 of the gas transfer block 40. The screw 42 through its swivel 64 may also be equipped with a fastener loop 69 for a rifle sling, not shown.

BOLT ACTION

For high powered ammunition, the semi-automatic firearm employs the previously noted bolt assembly 35, FIGS. 1 and 10, comprising bolt 70 and the bolt carrier 54. The bolt 70 is the primary mass and houses a firing pin 71 and a shell extractor 72. The bolt carrier 54, combined with a connecting link 73 and an action spring plunger 74, constitutes a secondary mass or inertia body. By pulling rearwardly on a charging handle 75 secured to the bolt carrier in a manner to be described, according to a feature of the invention, a pair of lugs 76 on the interior side walls of the generally U-shaped bolt carrier will engage two recessed cam faces 77 on opposite sides of the bolt 70 and cam the bolt downwardly or away from a locking shoulder 78 on the top wall of receiver 31. This unlocks bolt 70, allowing it to travel rearwardly with the bolt carrier 54, to its rearmost position illustrated in FIG. 7, compressing an action spring 79 contained in the tubular housing 37, located in the buttstock 32.

Upon releasing of the charging handle 75, the action spring 79 will move the bolt assembly 35 including bolt carrier 54 and bolt 70 in the forward direction, such movement being guided by the side walls 80 of the receiver 31 and the upper edges 81 of a trigger housing 82. This forward movement of the bolt assembly under influence of the spring 79 forces a cartridge 83, FIG. 7, from the magazine 39 and into the firing chamber 84 to complete the charging of the firearm. When the bolt 70 engages the forward end wall 85 of the receiver 31, FIG. 6, and the bolt carrier 54 is still traveling forwardly, the lugs 76 of the bolt carrier will ride under the inclined camming faces 86 of the bolt and will enter notches 87 immediately ahead of the camming faces 86 to elevate the rear end of the bolt 70 with a tilting motion, thus locking the bolt firmly against the receiver locking shoulder 78.

The above-described bolt action takes place automatically when the rifle is fired. Upon firing a cartridge, the described short stroke gas system drives the actuator 36 rearwardly and its arms 50 strike the open front ends 53 of bolt carrier 54 moving the action automatically through its work stroke, as will be clear to anyone skilled in the art.

Figures 12, 13, 14, 15:
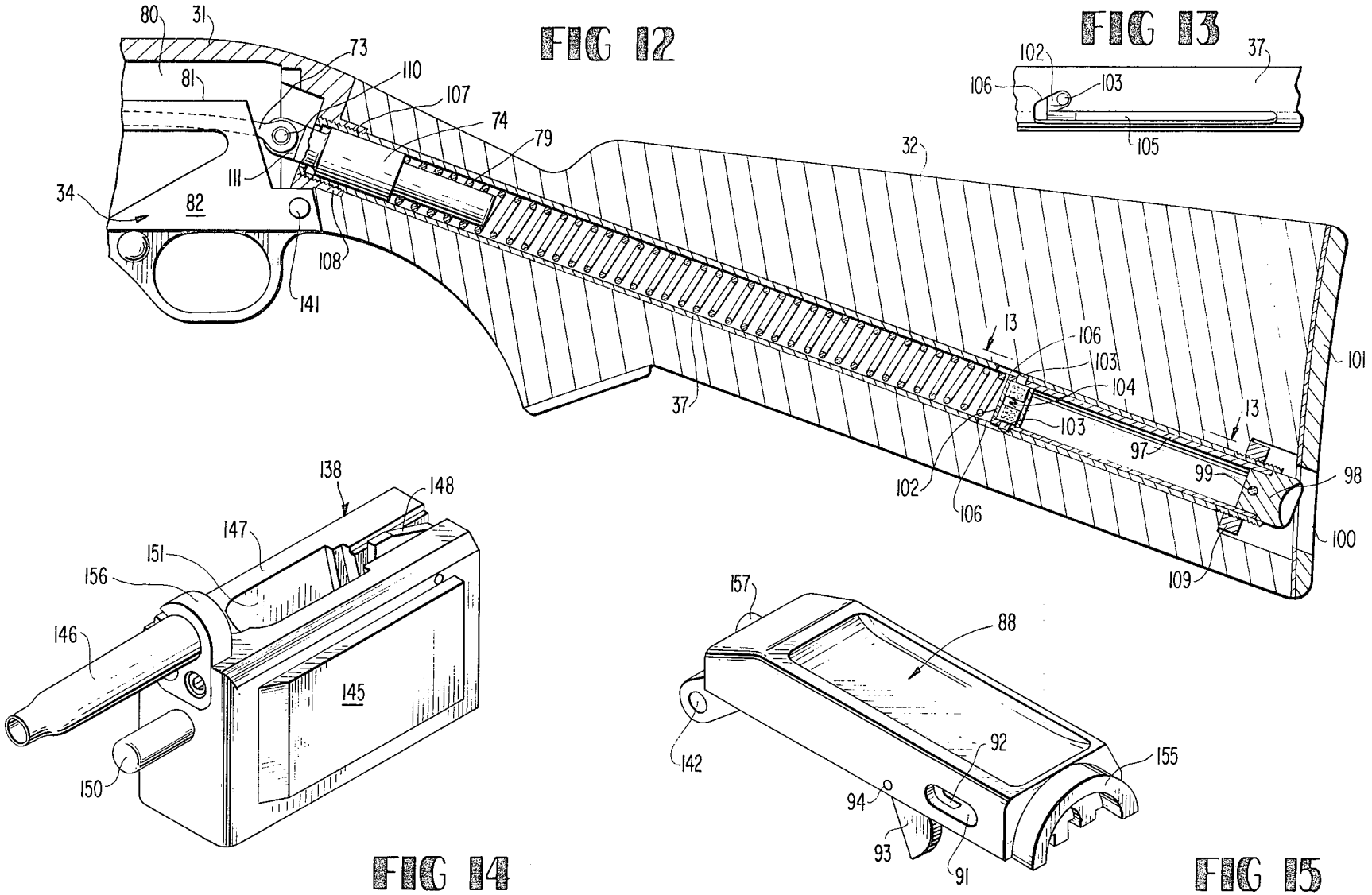
FIG. 12 is a fragmentary longitudinal vertical section through the rifle at the buttstock and action spring means including means to release the action spring tension.
FIG. 13 is a fragmentary side elevation of a portion of the action spring housing or tube.
FIG. 14 is a perspective view of a 22 calibre long rifle rimfire cartridge and magazine adapter.
FIG. 15 is a perspective view of a non-locking blowback bolt employed with the smaller rimfire ammunition.

A feature of the invention is embodied in the means for removably attaching the charging handle 75 to the bolt carrier 54 of locking bolt assembly 35 or to a unitary blow-back bolt 88 of a non-locking type, FIG. 15, employed in the conversion of the firearm to low cost and low power rimfire ammunition. This attaching means comprises an interior oblong extension 89 on the charging handle 75 which is received in a mating side wall opening 90 of the bolt carrier 54 or a like mating opening 91 of the bolt 88, FIG. 15. The bolt carrier is additionally provided in its bottom face with a slot 92 which intersects the opening 90 and receives an eccentrically pivoted locking key 93 on plate having a pivotal connection at 94, FIG. 11, with the adjacent side wall of the bolt carrier 54. The handle extension 89 has a slot 95 which receives the plate 93 lockingly when the parts are assembled as the FIGS. 9 and 11. An adjacent ledge 96 of the receiver 31 and one top edge 81 of the trigger housing 82 prevents downward pivoting of the locking plate 93 in any working position of the bolt carrier and thus the charging handle is retained safely on the firearm. The identical charging handle attaching or locking means is employed on the rimfire bolt 88. The receiver 31 has a side wall slot 75' through which handle 75 may travel fore and aft.

Closely allied with the described bolt action and forming a further feature of the invention is an action spring release means shown in FIGS. 12 and 13 which facilitates disassembling of the firearm for cleaning or for changing bolts when converting from one form of ammunition to another. The action spring release means comprises a cylindrical tube 97 inside of the action spring tubular housing 37 rotatably. A notched fingerpiece 98 is pinned at 99 to the tube 97 and is accessible for manual operation through an opening 100 in a butt plate 101. A cylindrical insert 102 fixed in the forward end of tube 97 has a crossbore for the reception of a pair of stepped cylindrical pins 103 with a compression spring 104 intervened therebetween to urge these pins outwardly in opposite directions. The outer terminals of stepped pins 103 are received in longitudinal slots 105 formed through action spring housing 37, and which slots have bayonet pin locking terminals 106 which may also receive the stepped pins 103.

The assembled elements 97, 98 and 102 form a movable plunger within the tubular housing 37 which is opposed by the action spring 79. When the pins 103 are locked in the slot terminals 106, as shown, the action spring 79 is under full tension tending to urge the plunger 74 forwardly with link 73 and bolt assembly 35. To release the tension of spring 79 for the stated purposes, the fingerpiece 98 is engaged and forced inwardly while rotation is being imparted to the plunger sufficiently to bring the locking pins 103 into alignment with the straight slots 105. Approximately ten degrees of rotation of the manual plunger will suffice. The action spring 79 will now force the manual plunger rearwardly through the opening 100 until the pins 103 bottom in the rear ends of straight slots 105. In this position, the tension of action spring 79 is substantially relieved so that it offers little resistance to retraction of the bolt assembly 35 and associated elements. To restore normal tension in the action spring 79, the manual plunger is moved axially forwardly in the tubular housing 37 to align the pins 103 with the entrances of slot extensions 106, twisted and then released.

The forward end of tubular housing 37 is threaded as at 107 into a rear sleeve extension 108 of receiver 31. Nut 109 releasably secures the rear end of housing 37 in the buttstock 32.

Figure 22:
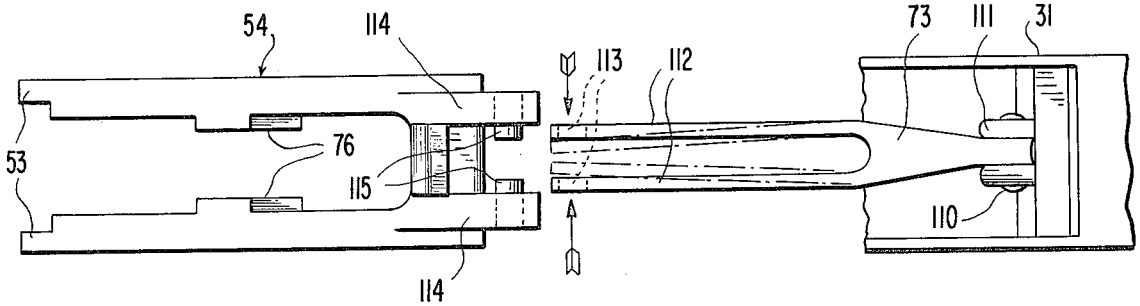
FIG. 22 is an exploded bottom plan view of the locking bolt carrier and link for connecting same with an action spring plunger.

The previously-mentioned connecting link 37 has its rear end pivotally connected at 110 to apertured knuckles 111 of the plunger 74. As best shown in FIG. 22, the link 73 is bifurcated to form thereon resilient parallel arms 112 which are apertured at 113 near their leading ends. Rear depending lugs 114 on the bolt carrier 54 have inwardly facing short connector pins 115 rigid therewith. The link 73 is readily connectable with the bolt carrier 54 by deflecting the arms 112 inwardly as shown in broken lines in FIG. 22 and engaging the apertures 113 with the pins 115 of the bolt carrier to form a pivotal connection between the elements.

FIRING MECHANISM

The firearm includes an improved firing mechanism previously-identified by the numeral 34 and including the aforementioned trigger housing 82 whose spaced side walls provide the edges 81 for the fore and aft guidance of the bolt assembly, as described. More particularly, the firing mechanism comprises a hammer 116, a sear 117 and a trigger 118. The sear and trigger are mounted on a common pivot pin 119. The sear 117 and sear spring 120 are located in a center cavity 121 of the trigger 118. The trigger has a forward extension 122 to cooperate with a safety 123. Sear spring 120 forces the sear 117 to pivot about pin 119 in a clockwise direction which is limited by contact with a surface 124 of the trigger 118. A torsion spring 125 mounted on the cylindrical pivot hub 126 of the hammer 116 forces the hammer into counterclockwise rotation about pivot pin 127 and serves also as a trigger spring, with the two legs 128 resting on a protruding pin 129 in the trigger, forcing the trigger about its pivot pin 119 in a clockwise direction. The pin 129 also acts as a stop for the trigger by contact with the bottom wall 130 of the trigger housing 82.

Figure 6:
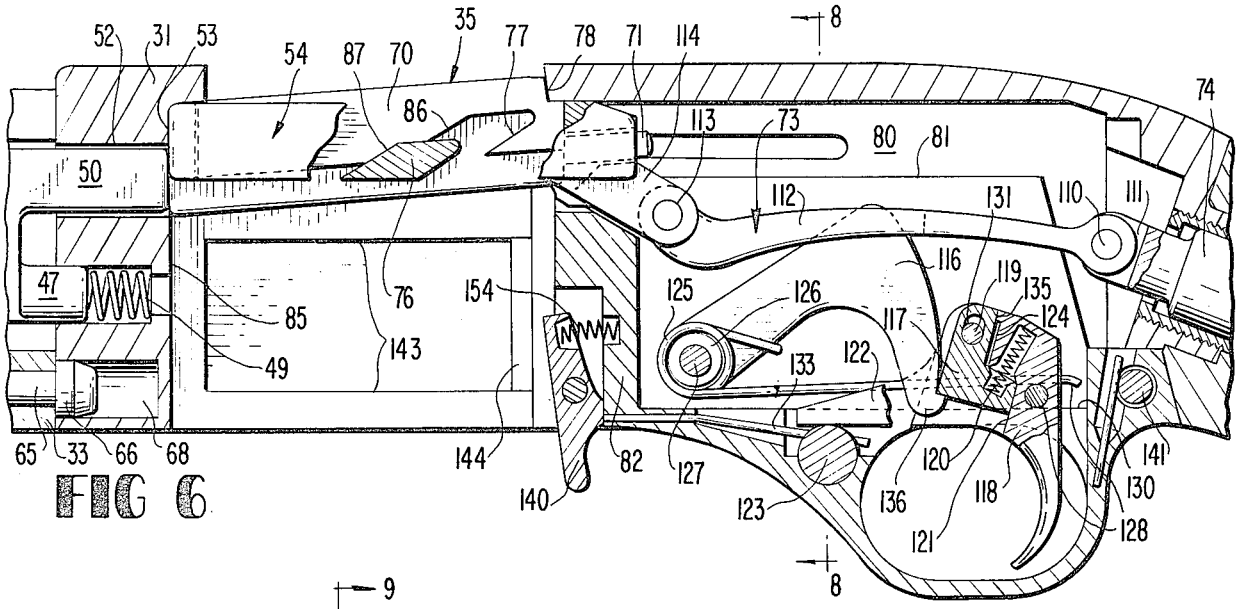
FIG. 6 is a fragmentary longitudinal vertical section taken through the rifle at the receiver with the center fire bolt assembly in locked position, hammer cocked, safety "on," and magazine removed for clarity.

An elongated opening 131 in the sear 117 allows the necessary movement of the sear on the fixed pin 119 to catch the hammer 116 whether the trigger is depressed or not, FIGS. 16 and 6.

Figure 7:
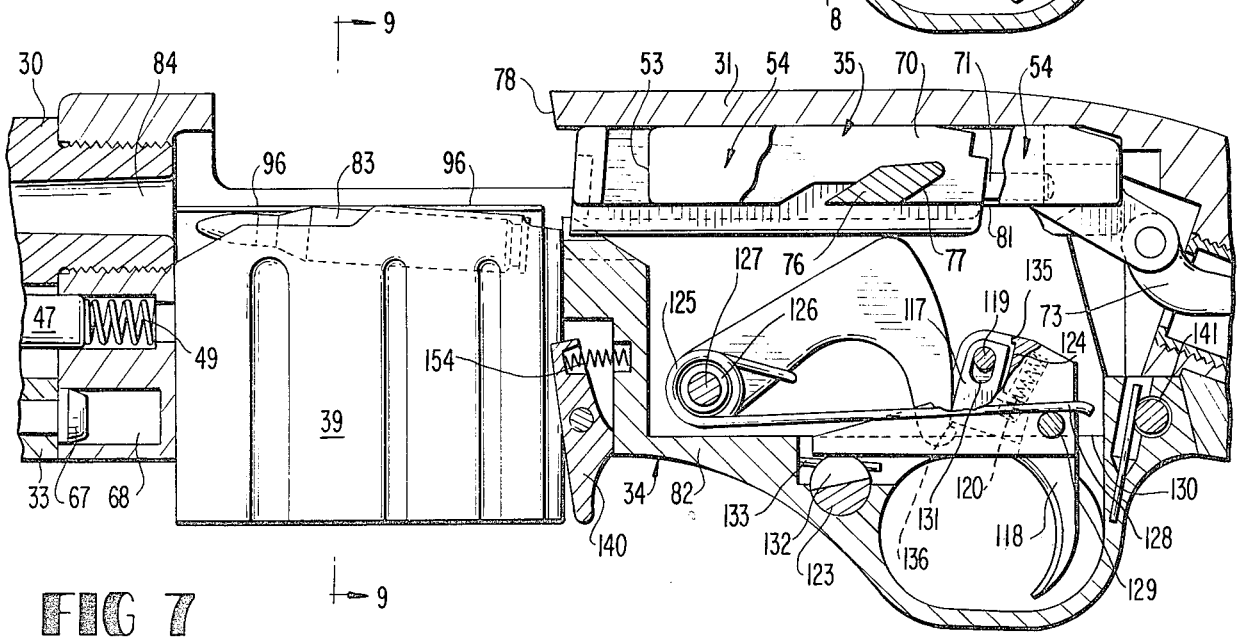
FIG. 7 is a similar cross sectional view showing the bolt assembly unlocked and fully retracted, magazine in place ready to chamber a cartridge, hammer cocked and safety "off".

FIG. 6 shows the safety 123 "on" and the hammer engaged by the sear. The trigger extension 122 rests firmly on the safety and the trigger cannot be depressed or pulled. FIG. 7 shows the safety "off" and hammer engaged. By depressing the trigger 118, extension 122 can now move into notch 132 of axially shiftable safety 123, which is maintained in the "off" or "on" position by a spring arm 133, FIG. 8, and two cooperating detent notches 134. The spring arm 133 is anchored to the trigger housing 82 as shown in FIG. 6. Sear 117 and trigger 118 can now rotate on their common pivot 119 counterclockwise. The trigger nose 135 forces the sear off of the hammer nose 136, permitting the hammer 116 to fly forwardly and strike the firing pin 71. At a firing cycle, when the trigger is depressed, as in FIG. 16, the sear 117 is forced downwardly on its elongated opening 131 by the sear spring 120 and rests on surface 124 in the trigger. When the hammer is again forced downwardly by retraction of the bolt 70, FIG. 7, it engages the sear 117 in this latter position. When the trigger is permitted to return to its normal position, FIG. 6, the sear 117 moves upwardly on its elongated opening 131 and rests again on the trigger nose 135. This concludes the firing mechanism cycle of operation which can now be repeated.

THE CONVERSION

As stated previously, the main object of the invention is to provide a semi-automatic firearm having dual capability. FIGS. 14 through 19 of the drawings deal primarily with the parts involved in the conversion. The sportsman can select a certain type of shooting by owning a single rifle. Within seconds, he can place the bolt assembly in the receiver 31 to fire high powered center fire cartridges 83 or low cost 22 rimfire cartridges 137, FIG. 16. Since the rifle was designed from the beginning with this dual capability in mind, a sportsman could purchase the rifle with the proper parts to fire 22 rimfire cartridges only, and decide later to buy the parts necessary to fire high powered center fire cartridges, or vice versa.

As shown in the drawings, the components necessary to fire 22 rimfire cartridges include the bolt assembly 88, previously identified, an adapter assembly 138 and a magazine 139. The components required to fire high powered center fire cartridges and already described in detail are the bolt assembly 35 and the magazine 39. All other components are common to the two versions of the invention. To convert the system to one capable of firing 22 rimfire cartridges, no special tools whatsoever are needed. Only a pointed object, such as a bullet point or ball point pen, is utilized. The conversion procedure is as follows:

1. Remove the magazine 39 by releasing the pivoted spring-urged magazine latch 140, FIG. 7, and make certain that now cartridge 83 remains in the chamber 84.

2. Release the tension of the action spring 79 by manipulating the plunger assembly consisting of elements 97, 98 and 102, etc., as previously described.

3. Push out the spring-held pin 141 and swing out the trigger housing 83 from the receiver.

4. Pull back the bolt assembly 35 by means of handle 75 as shown in FIG. 7. With the tension on action spring 79 released, the bolt assembly will remain retracted. With a pointed object, engage the locking key 93 which will freely pivot on the pin 94 to release the charging handle 75 which is removed. The bolt assembly 35 is now removed through the rear bottom of the receiver chamber.

5. Separate the connecting link 73 from the pins 115 of bolt carrier 54, as previously described.

6. Engage the connecting link 73 with the corresponding pins 142, FIGS. 15 and 16, of the rimfire blow-back bolt assembly 88 which replaces the center fire bolt assembly 35 in the firearm, and re-attach the common charging handle 75.

7. Now the adapter assembly 138 can be inserted through the rear bottom of the receiver 31. A straight forward motion will slide the assembly 138 into position between parallel vertically spaced side rails 143 of the receiver 31. Following this operation, the common trigger housing 82 with the described firing mechanism can be set into place. Forward stepped side wall projections 144 of trigger housing 82 enter between the rails 143 to support the front of the trigger housing, and the spring-held pin 141 supports the rear of the trigger housing firmly in the receiver. At the same time, the arrangement prevents the adapter assembly 80 from moving horizontally longitudinally. Side projections or bosses 145 on the adapter assembly 138, FIG. 18, are also received guidingly between the rails 143. Integral parts of adapter assembly 138 are chamber 146 for rimfire cartridges 137, magazine holder 147, ejector 148, magazine latch 149 and pin 150. The rigid pin 150 blocks or disables the gas operated actuator 36 while the rimfire blow-back bolt assembly 88 is in use, by entering the bore 48, FIG. 16, and opposing rearward movement of actuator element 47.

8. A filled magazine 139 for the 22 rimfire cartridges 37 is then inserted in the magazine holder 147 which has a passage 151 to receive the magazine. A magazine nose or detent 152, FIG. 16, engages the bottom of holder 147 and the spring-loaded latch 149 snaps into a notch 153 of the magizine. The latch 140 used to hold center fire catridge magazine 39 in place operates in conjunction with the latch 149, as shown in FIG. 16, the spring 154 of latch 140 acting against the weaker spring of latch 149, thus assuring a firm locking of the magazine 139.

PROTECTION AGAINST PREMATURE FIRING

In semi-automatic 22 rimfire rifles, where the bolt is held against the base of the cartridge by an action spring (blow- back action) as in the present firearm, it may happen that a malformed or weak cartridge is not fully chambered. When fired, the bottom of the cartridge or a part thereof may blow out, and brass splinters and hot gases are forced rearwardly toward the face of the shooter creating a dangerous situation. In the present invention, the bolt assembly 88 has a forward hood 155, FIG. 15 and FIG. 16, which fits over a rear shoulder 156 of chamber 146. Thus, when a weak cartridge blows out, the splinters and gases are directed forwardly or away from the shooter's face where they can do no harm.

The firing pin 157 for rimfire bolt assembly 88 is also indiated in the drawings, see FIGS. 15, 16 and 19.

BOLT STOP FEATURE

In semi-automatic sporting rifles where the receiver construction is such that the bolt is not readily removable through the rear end of the receiver, it is convenient to have means for holding the bolt open for such reasons as cleaning the barrel with a patch or brush where the chamber end of the barrel can be seen, ventilating the barrel between shots, feeding single cartridges by hand and for additional safety. In the present invention, according to both versions thereof, FIGS. 20 and 21, a simple means is provided for holding the bolt open without the addition of any new parts.

Figure 20:
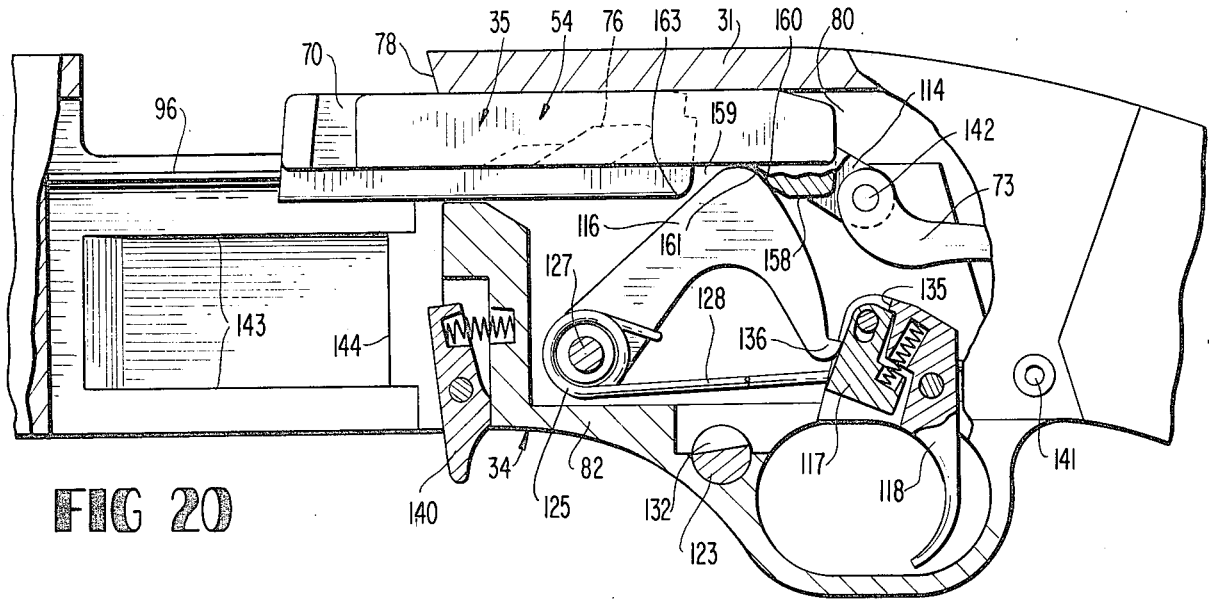
FIG. 20 is a similar cross sectional view showing the center fire locking bolt assembly in a held-open position in accordance with a feature of the invention.
Figure 21:
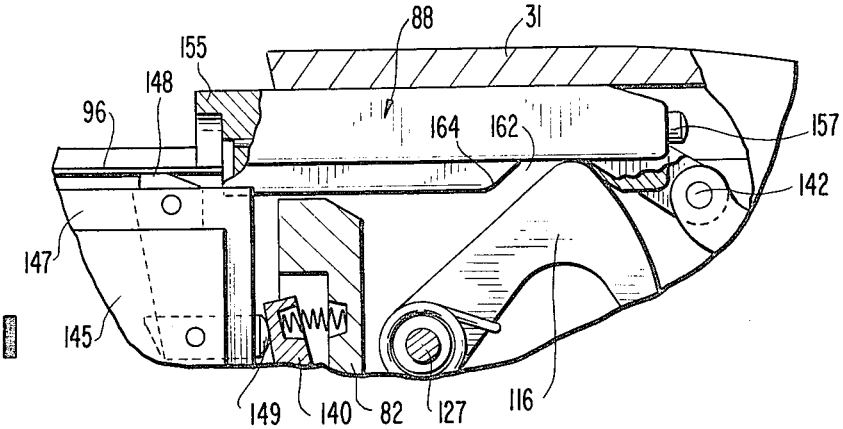
FIG. 21 is a similar view showing the rimfire bolt in a held open position.

Referring to FIG. 20, this feature is accomplished in the high powered center fire rifle embodiment by removing the magazine 39 and adjusting the safety 123 to "off" so that the trigger 118 can be depressed. The bolt assembly 35 is pulled by the handle 75 to the rearmost position. The bottom surface 158 of bolt carrier 54 has now cammed the hammer 116 down into engagement with sear 117 as shown in FIG. 7. The trigger is now depressed and the bolt assembly 35 is allowed to move slowly forwardly. With the trigger depressed, sear 117 will disengage the hammer. forced by the torsion spring 125, the hammer 116 enters a pocket 159 created in the unlocked bolt assembly. In this position, the shoulder 160 of bolt carrier 54 rests against the hammer back 161 and locks the bolt assembly in the intermediate position shown in FIG. 20.

The bolt stop or hold-open feature of the invention functions in essentially the same manner for the 22 rimfire action, where a pocket 162 is provided in the bottom of the unitary blow-back bolt 88.

To move the bolt assembly home, it is simply necessary to pull the bolt assembly back to its rearmost position and release it. Shoulder 163, FIG. 20, and shoulder 164, FIG. 21, will cam the hammer 116 downwardly and engage it with the sear 117. The bolt assembly driven by the action spring 79 can now move freely home.

It should now be apparent to those skilled in the art that the dual purpose, easily convertible, sporting rifle is provided by the invention in which a number of novel features directly interact to render the firearm efficient, convenient to use, comparatively economical and very safe. The design is uncluttered and compact and proper feel and balance are maintained in each embodiment or version. The invention fulfills a definite need in a practical manner and the many advantages of the invention should now be clear without further elaboration.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A dual purpose convertible rifle comprising a receiver adapted selectively to hold a locking bolt assembly and a magazine for high powered center fire cartridges and a non-locking blow-back bolt for low powered rimfire cartridges and an adapter for the rimfire cartridges, said adapte being unitary and comprising a holder body for a rimfire cartridge magazine including a latching means for such magazine and a forward chamber extension for rimfire cartridges insertable into an existing chamber of the rifle for said high powered center fire cartridges, a firing mechanism common to said high powered and low powered cartridges including a housing mountable in said magazine and including a magazine latch engaging and releasably securing said magazine for high powered cartridges within the receiver and also engageable with said latching means for said rimfire cartridge magazine to activate the latter, a gas operated actuator means on the rifle ahead of the receiver including a rearwardly driven element adapted to strike said locking bolt assembly through an open forward passage of the receiver, and a member on said adapter for rimfire cartridges in the path of movement of said rearwardly driven element to disable said gas operated actuator means when said adapter for rimfire cartridges is in the receiver.

2. The structure of claim 1, and a charging handle adapted to be removably attached to either of said bolt assemblies, each bolt assembly having a side opening for the reception of an extension of said charging handle and having a pivoted keeper element, said handle extension having a slot formed therein to receive the pivoted keeper element, the pivoted keeper element being held in the handle locking position by sliding contact with a ledge of the receiver, and the receiver having a side wall clearance slot for said handle extension.

3. A dual purpose convertible rifle comprising a receiver adapter to hold a locking bolt assembly and a magazine for high powered center fire cartridges and to alternately hold a non-locking blow-back bolt assembly for low powered rimfire cartridges and an adapter unit for such rimfire cartridges, said adapter unit including a chamber member for said rimfire cartridges and a holder for a rimfire cartridge magazine, a gas operated actuator means on the rifle ahead of said receiver including a rearwardly driven element adapted to strike a forward part of said locking bolt assembly through an open forward passge of the receiver, a spring means opposing said rearwardly driven element and returning it to a normal forward position on the rifle after each firing cycle, an element on said adapter unit in the rearward path of movement of the actuator means to disable the actuator means when the adapter unit is in said receiver, said element on said adapter unit comprising a rigid forwardly projecting element blocking the rearward travel of the body portion of said actuator means, said forwardly projecting element and body portion projecting into a frontal recess of said receiver.

4. In a rifle, a barrel having a cartridge chamber, a receiver behind the barrel, a locking bolt assembly including a bolt and bolt carrier in the receiver, an explosion gas pressure operated actuator means connected with said barrel ahead of said receiver including a rearwardly driven actuator element adapted to strike a forward extremity of the bolt carrier when a catridge is fired to propel said carrier rearwardly in the receiver, said receiver having a forward open passage means for said driven actuator element in alignment with said forward extremity, a return spring means for said actuator element urging it forwardly, a buttstock behind said receiver, an action spring means in the buttstock, a link adapted to couple the action spring means with said locking bolt assembly in said receiver and to alternately couple the action spring means with a non-locking blow-back bolt assembly in said receiver after removal of the locking bolt assembly, and means accessible at the butt of the rifle to release the spring tension of said action spring means.

5. In a rifle as defined by claim 4, and said action spring means comprising a compression spring, a tubular housing for the compression spring within the buttstock, and said spring tension release means comprising a plunger unit mounted movably in the tubular housing behind said spring and having quick release coupled engagement with the tubular housing whereby the plunger unit may shift rearwardly in the tubular housing to release the tension of said spring.

6. In a rifle as defined by claim 4, and said link including a pair of spaced apertured resilient arms which may be flexed to engage the apertures of said arms with opposing pins on the rear end portions of the locking and non-locking bolt assemblies.

7. In a rifle, a barrel having a cartridge chamber, a receiver behind the barrel, a locking bolt assembly including a bolt and bolt carrier in the receiver, a gas pressure operated actuator means connected with the barrel ahead of said receiver including a rearwardly driven actuator element adapted to strike a forward extremity of the bolt carrier when a cartridge is fired to propel the carrier rearwardly in the receiver, said receiver having a forward open passage means for said driven actuator element in alignment with said forward extremity, a return spring means for said actuator element urging it forwardly, a unitized firing mechanism including a housing removably mounted in said receiver, a magazine for high powered center fire cartridges removably mounted insaid receiver ahead of said housing and releasably coupled thereto and coacting with the locking bolt assembly and firing mechanism for firing said high powered cartridges, an alternately used non-locking blow-back bolt assembly in said receiver, and a unitized adapter for low powered rimfire cartridges, said adapter including a holder for a rimfire cartridge magazine, said holder releasably coupled to said housing, a forward chamber element for rimfire cartridges on said holder adapted to enter an existing chamber for high powered cartridges ahead of said receiver, and a forwardly projecting blocking part on said holder engaging and blocking the rearward movement of said gas operated actuator means during the firing of low powered cartridges, said firing mechanism then coacting with said non-locking bolt assembly for firing low powered rimfire cartridges.

8. In a rifle, a barrel having a cartridge chamber, a receiver behind the barrel, a locking bolt assembly including a bolt and bolt carrier in the receiver, a gas pressure operated actuator means connected with said barrel ahead of the receiver including a rearwardly driven actuator element adapted to strike a forward extremity of the bolt carrier when a cartridge is fired to propel said carriage rearwardly in the receiver, said receiver having a forward open passage means for said driven actuator element in alignment with said forward extremity, a return spring means for said actuator element, a unitized firing mechanism including a housing removably mounted in said receiver, a magazine for high powered center fire cartridges removably mounted in said receiver ahead of said housing and releasably coupled thereto and coacting with said locking bolt assembly and firing mechanism in the firing of high powered cartridges, an alternately employed non-locking bolt assembly and adapter unit for low powered rimfire cartridges removably mountable in said receiver with said adapter unit releasably coupled to said housing, a part of the adapter unit arranged to block the operation of said gas pressure operated actuator means during the firing of low powered rimfire cartridges by coaction of said non-locking bolt assembly, adapter unit and firing mechanism, and said firing mechanism comprising a hammer having a hammer spring, a trigger and a sear having a common pivot on said housing, said sear having an elongated opening on said common pivot, a sear spring urging the sear rotationally in one direction on the common pivot relative to the trigger, said hammer including a hammer nose to catch a lower corner of the sear when the sear is in an upward position on said common pivot, the trigger having a trigger nose adapted to then engage the back of the sear, and the trigger having a recessed face below the trigger nose to engage the back of the sear when the sear is in a downward position on the common pivot, a safety on said housing having "on" and "off" positions, and a trigger extension adapted to engage said safety.

* * * * *